US005538163A

United States Patent [19]

Dassi

[11] Patent Number: 5,538,163

[45] Date of Patent: Jul. 23, 1996

[54] CLEANING/DISINFECTING APPARATUS FOR BATHROOMS AND TOILETS

[75] Inventor: Francesco Dassi, Novara, Italy

[73] Assignee: Mortech Technologies of North America Ltd., Cyprus

[21] Appl. No.: 356,195

[22] PCT Filed: Jun. 23, 1993

[86] PCT No.: PCT/EP93/01614

§ 371 Date: Feb. 21, 1995

§ 102(e) Date: Feb. 21, 1995

[87] PCT Pub. No.: WO94/00250

PCT Pub. Date: Jan. 6, 1994

[30] Foreign Application Priority Data

Jun. 24, 1992 [IT] Italy ..... MI920631 U

[51] Int. Cl.[6] ..... B05B 1/24; B08B 3/00

[52] U.S. Cl. ..... 222/146.5; 239/136

[58] Field of Search ..... 239/135–137; 222/146.5; 219/240, 242; 392/124, 131, 134

[56] References Cited

U.S. PATENT DOCUMENTS

| | | | |
|---|---|---|---|
| 4,784,616 | 11/1988 | Zimmermann | 439/568 |
| 4,826,049 | 5/1989 | Speer | 222/146.5 |
| 4,835,363 | 5/1989 | Hoffmann | 219/258 |
| 5,044,556 | 9/1991 | Suzuki | 239/135 |
| 5,427,125 | 6/1995 | Mezu | 134/95.3 |

FOREIGN PATENT DOCUMENTS

| | | | |
|---|---|---|---|
| 4035858 | 5/1992 | Germany . | |
| 766607 | 1/1957 | United Kingdom | 239/137 |

*Primary Examiner*—Kevin P. Weldon
*Attorney, Agent, or Firm*—Diller, Ramik & Wight

[57] ABSTRACT

The present invention relates to a suitable apparatus for cleaning water closets bowls by concentrated water and steam jets and for in disinfecting the bowls. The apparatus includes a portable hand-held dispenser body provided with a water tank, heating element, pump and rechargeable battery supply means. The dispenser is received in a recharging socket having a timing mechanism for setting the period of time electricity is connected to the rechargeable battery in the dispenser body after use. A pawl on the socket that cooperates with the dispenser body prevents the timing mechanism from operating whenever the dispenser body is removed from the socket.

5 Claims, 5 Drawing Sheets

1
2
3
4
5
6
7
8
9
10
11
12
13
14
15
16
17
18
19
20
21
22
23
24
25
26
27 a.
b.
c.
d.
1
2
15
16
27
28
31
32
33
34
35
39
41
42
43
II°
III°

43
27
21
26
44
23
24

CLEANING/DISINFECTING APPARATUS FOR BATHROOMS AND TOILETS

BACKGROUND OF THE INVENTION

The present finding relates to a suitable apparatus for the end cleaning of the water closet (WC) bowls by means of concentrated water jets, and, for disinfecting them and their seat, by means of steam jets.

It frequently happens that, after that the physiological evacuation has been performed, the water flushing stream commanded by the user by a pushbutton, a handle, a chain system, or the like, is not enough in order to adequately clean the water toilet bowl and that some residues of excrements may remain tenaciously sticking to the inner surface. In these cases, use is made of the purposely provided brush, which is a standard toilet fitting.

Such a kind of operation, which, per se, is not so pleasant, is also an unhygienic one, because a portion of removed matter unavoidably remains on the same brush, and even repeated flushes are surely insufficient for a thorough cleaning of the bristles, so that the user will place again the brush inside its container being perfectly aware that he is storing some "foreign matter" together with it—although both said parts, i.e., the brush and the container are usually thoroughly cleaned from time to time.

Another problem, still arising in connection with the use of the water closet bowl, relates to the seat, i.e., where the toilet user seats.

Not always said seat is clean, and besides all, in particular in the case of toilets shared by a plurality of users, e.g., in large office buildings, communities, restaurants, and so forth, it certainly does not gain the users' confidence; on the contrary, a great mistrust, and, as a matter of fact, the application has spread of dispensers (nearly always against payment) of paper rings suitable for covering the toilet bowl seat.

Now, with the validity of such an approach being fully acknowledged—paper ring is an extremely good isolating means for dirt and germs—it, in our opinion, is anyway still affected by a number of weak points, such as, e.g., a further paper waste, the relatively high cost of the dispenser unit, the objective difficulty of a diffusion thereof in private homes, in which it would be unaesthetic and expensive.

Concrete doubts may however be raised also in those cases when this device is installed, because it may happen that owing to such reasons as avarice, lack of immediate availability of coins or tokens, faults, store exhaustion, and the like, this service cannot be taken advantage of.

It may also happen that sometimes, before applying the paper ring, a summary cleaning or drying of the water closet seat must be forcedly carried out.

SUMMARY OF THE INVENTION

The purpose the instant finding aims at achieving, precisely is of overcoming the drawbacks complained hereinabove, by providing a portable, cleaning/disinfesting apparatus easily hand-traversed by the user, which efficaciously and meticulously performs the removal of the residues of excrements from the water toilet bowls, and the disinfection of their seats, without never coming into contact with them.

Within the scope of the above purpose, a particular purpose of the present finding is of providing a clean/disinfecting apparatus which, by remotely acting with the water jet or the steam jet, remains as clean and pure as it was before being used and which, in these conditions, may be safely stored.

Another purpose of the present finding is of providing a cleaning/disinfecting apparatus which is so constructed as to render particularly simple and easy the cleaning and disinfection operations throughout the bathrooms and toilets, thus contributing to meet the desired hygienic requirements.

Not least purpose of the instant finding is of providing a cleaning and disinfecting apparatus which is particularly versatile, has small overall dimensions and is of a competitive cost.

The above purpose, as well as the other briefly mentioned purposes and still other purposes which will be clearer from the following, are achieved by a cleaning/disinfesting apparatus aiming in particular at keeping the bathroom services, toilets and their relevant fittings in hygienic conditions, according to the present finding, which is characterized in that it comprises a portable apparatus suitable for being hand traversed by the user, provided with a tank suitable for being filled with water, and containing the suitable devices for generating, on command by the user, water jets and steam jet, respectively, and additionally provided with a power supply pot or support means equipped with an electrical tap, battery charger, timer and connectors, suitable for supplying the electrical power and heat accumulators the apparatus is equipped with.

Thanks to its electrical power and heat accumulators, the apparatus is capable of operating as a stand-alone water jet and steam jet generating unit, disconnected from both the power supply pot or support means and any electrical power supply cables from main taps.

Further characteristics and advantages will be clearer from the following disclosure of a preferred, not exclusive, embodiment of a cleaning/disinfecting apparatus in particular for water closet bowls and seats, illustrated, for indicative and not limitative purposes, with the aid of the accompanying drawings, in which:

DESCRIPTION OF THE PREFERRED EMBODIMENTS

Figure 1:
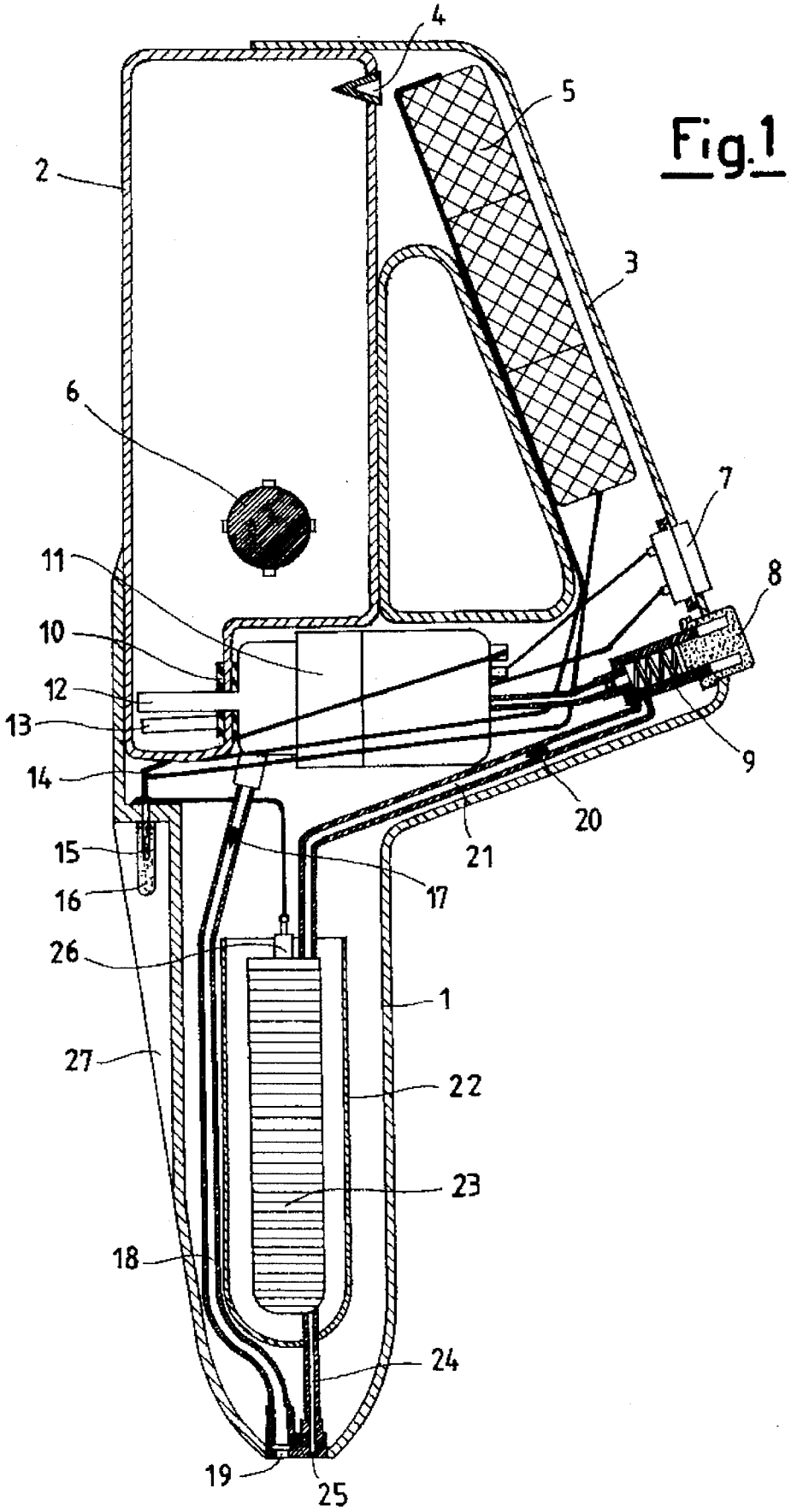
FIG. 1 shows a sectional view made along the line III—III of FIG. 4, of the "cleaning/disinfecting" apparatus separated from the power supply pot or support means, according to the present finding.

Referring to the above Figures, the "cleaning/disinfecting" apparatus for water closet bowls and seats, according to the present finding, comprises a hollow body (1) having a preferably, but not mandatory, cylindrical shape, provided with a handle (3) inside which the electrical power accumulators (5), the motor driven pump (11) switchgear (7) and the steam pump (9) are housed.

Inside the upper portion of the body (1) the water tank (2) is housed; said water tank (2) is equipped with a filling cap (6), the check valve (4) and the gasket (10) enabling the pump suction tubes (12 and 13) to pass through under tightly sealed conditions.

In the central portion of said body (1) the motor driven pump (11), the delivery ducts (18, 21) of both pumps with their relevant check valves (17, 20) and the electrical wiring (14) are installed and inside the external picket (27) the outwards protruding power supply pins (15, 16) can be seen.

Inside the bottom portion of the body (1), the heat accumulator (23) closed inside its thermal shield (22), the steam duct (24) and the water duct (18), leading to the external diffusion nozzles (25, 19, respectively), are installed.

Figure 2:
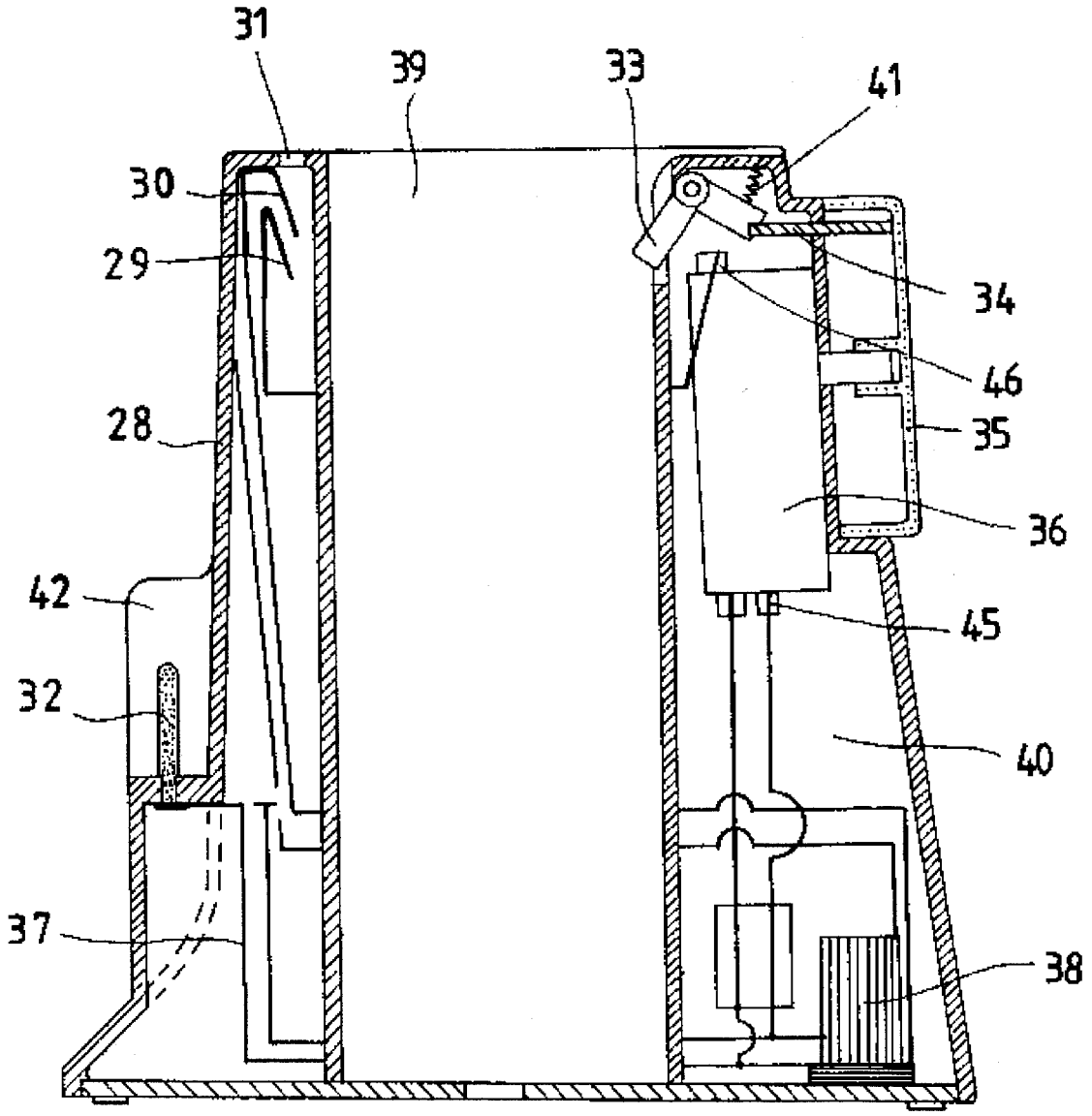
FIG. 2 shows a sectional view made along the line II—II of FIG. 4, of the power supply pot or support means, according to the present finding.
Figure 3:
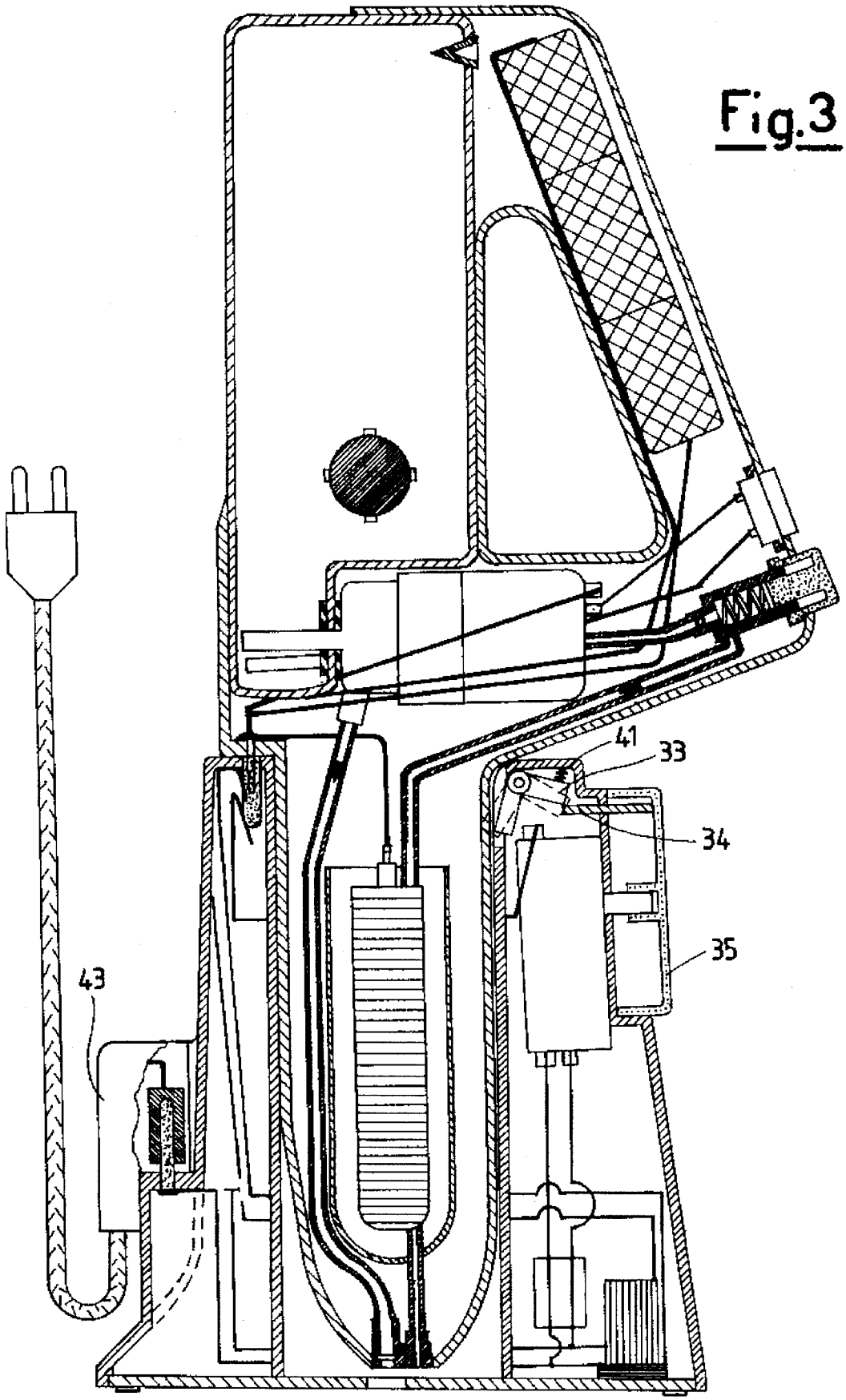
FIG. 3 shows a sectional view made along the lines III—III and II—II, respectively, of FIG. 4, of the "cleaning/disinfecting" apparatus stored inside its power supply pot or support means.
Figure 4:
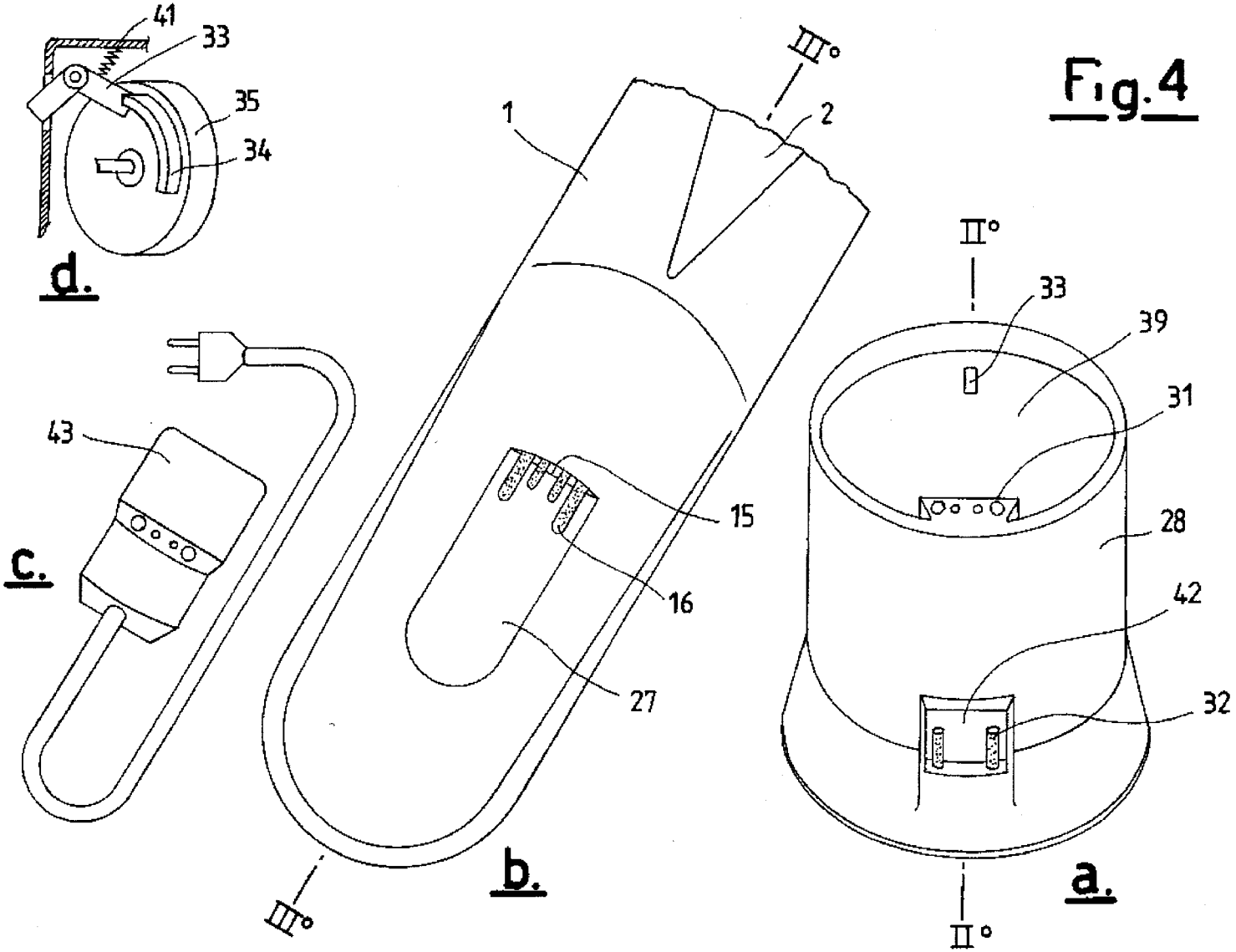
FIG. 4 shows: in A, a perspective view of the power supply pot or support means, in B, the partial projection of the "cleaning/disinfecting" apparatus in C, the removable connector for electrical power supply, and in D, in a perspective cut-away show, the detail of the safety pawl.

Said apparatus additionally comprises a power supply pot or support means, displayed in FIG. 2, which preferably, but not mandatorily, is given the shape of a double-chamber pot, in which the central chamber (39) is open at its top side in order to enable the "cleaning/disinfecting" apparatus to be slid and positioned into it in dagger-into-sheath fashion, as shown in FIG. 3, and the peripheral chamber (40), totally closed by an outer peripheral wall (28), houses the electrical wiring (37), the battery charger (38), the timer (36), the contact blades (29, 30) and the safety pawl (33).

The power supply pins (32) and the control knob (35) of the timer (36) protrude outwards of the wall (28) with the supply pins (32) being located in a housing recess (42).

When the apparatus is used in practice, with the power supply pot or support means being connected with the mains, and the apparatus already filled with water having been slid into it—as shown in FIG. 3—the apparatus power supply pins (15, 16) come into contact with the power supply blades (29, 30) and, thanks to the carefully calculated free gaps, the lock lever of the safety pawl (33) is pushed by the body of the apparatus until the safety pawl (33) gets disengaged from the constraint constituted by the cams (34) of the timer control knob (35) against the bias of a spring (41).

In this condition, the "prearranged" electrical system enables the electrical current supplied by the mains to be directly fed to the transformer/battery charger (38) and its voltage is reduced by this unit to a low voltage value, and then the by now low-voltage power is fed to the contact blades (29, 30) and then through the power supply pins (15, 16) and so forth, to the electrical energy accumulators of the apparatus, with their charge being thus secured and then, still directly, to the poles of the "open" electrical circuit of the timer (36), thus leaving idling and current-free the blades (29, 30) which are into contact with the pins (15, 16) designed to supply electrical power to a heater (26, FIG. 5) associated with an evaporation chamber (44) of the heat accumulator (23).

The above disclosed situation is the classic stand-by state in which the user will find the "cleaning/disinfecting" apparatus for water closet bowls and seats installed in bathrooms and toilets, at toilet use time.

In order to suitably use said apparatus as a clean/washing unit, the user will take it out of the pot or support means and will actuate the switchgear (7) which controls the motor-driven pump (11), which will suck water from the water tank (12), in order to deliver it, downstream from the check valve (17), through the water duct (18), to the water diffusion nozzles (19) which will spread water into the outer environment.

As the apparatus can be easily hand traversed by the user, it will enable the user thereof to direct the jets according to as desired by the user.

When, on the contrary, still by starting from the above disclosed stand-by condition, should the user wish to use the apparatus for disinfecting purposes, he will first act on timer knob (35), which no longer being under the constraint by the pawl (34), can now be freely rotated, thus enabling the electrical circuit of this component to be closed and electrical current to flow from the pins (15, 16) into contact with the blades (29, 30), by now active, to the heat accumulator (22), for that short time period which is necessary for the apparatus to generate steam. A sound or light signal will indicate when the apparatus is ready to perform the requested function.

Once more, after removing the apparatus from its support means, it will be enough that the user actuates the pushbutton (8) which controls the steam pump (9), in order that water sucked from water tank (12) is delivered, beyond the check valve (20) inside the delivery duct (21), into the evaporation chamber of the heat accumulator (22), which said water will leave, by now, as steam.

The steam jet sent to the external diffusion nozzle (25) can be suitably directed by traversing the apparatus.

An important feature of the present finding is its functional operating duration in standalone mode, in which it is disengaged from its power supply pot or support means, as well as from any mains connection cables, because, by virtue of the electrical power accumulators which it contains, the cleaning/disinfecting apparatus is practically always capable of operating as a cleaning/washing device, with its water jets.

This is so, because the charging times, i.e., the "stand-by position inside the power supply pot or support means" times, are extremely longer than the discharge times, i.e., the "motor-driven pump actuation" times.

However, thanks to the mass of its heat accumulator, and, above all, to the thermal shield which reduces heat dispersions, despite the extremely short time period during which electrical power is supplied as programmed by the timer, the apparatus is capable of generating high-temperature steam in a more than enough amount in order to disinfect the water closet bowl and seat, before their use.

Another important feature of the present finding is that both in the power supply pot or support means, and in the "cleaning/disinfecting apparatus", pockets designed to house the power supply pins have been provided with a perfectly identical shape; with also the special "pitch" of the installed pins being the same.

Figure 5:
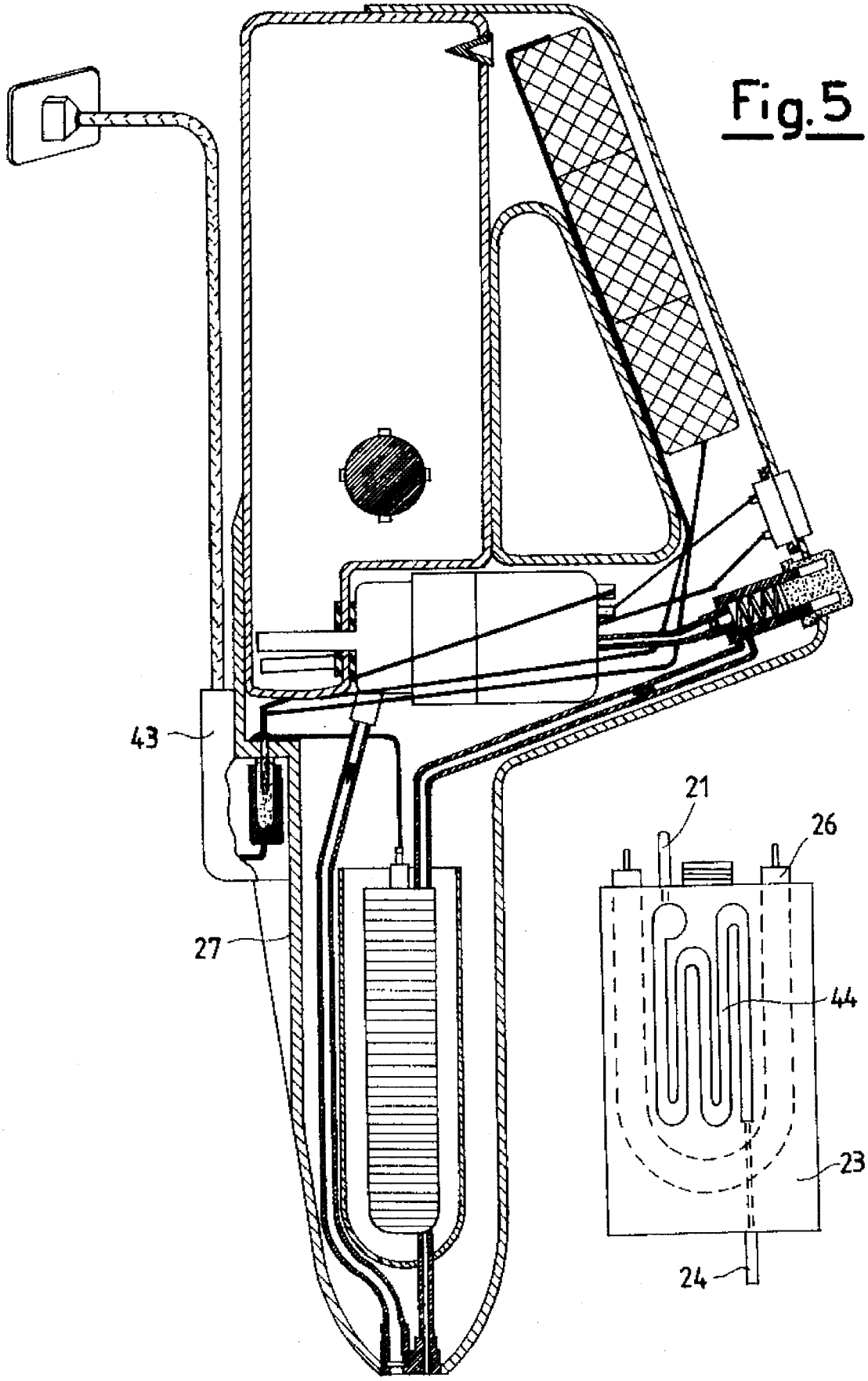
FIG. 5 shows the "cleaning/disinfecting" apparatus according to the present finding, connected with the mains by means of a power supply cable, and a cutaway plan view of the heat accumulator unit.

In that way, connecting the apparatus with the mains by means of a power supply cable is made possible by inserting the relevant connector into its compatible pocket, as displayed in FIG. 5.

Without endangering the electrical safety, with the connector being firmly retained thanks to its particular dove-tail shaped cross-section being complementary to the shape of the cross-section of the connecting pickets, the apparatus will thusly reach a very long standalone operating duration and, thanks to its feature of being portable and easily hand traversed by the user, it can be used as a cleaning/washing unit, as well as a disinfesting unit, over the whole span of the bathroom.

Another important feature of the present finding is constituted by a safety system applied to the power supply pot or support means in order to prevent any accidental, or unconsciously voluntary, contacts with the live parts of the electrical system.

When the power supply pot or support means is connected with the mains, and the apparatus is out of it, the passages provided for the power supply pins of the apparatus to pass through, remain accessible.

By sliding, more or less accidentally, as said, a foreign metal body into these small holes, one would meet with one pair of live contact blades through which only low-voltage, hence harmless, current flows and with another, absolutely idling, pair of blades, because the electrical system provided inside the power supply pot or support means is conceived in order to directly supply the electrical current from the mains to the battery charger/transformer unit and then, from the latter, by now as a low-voltage current, to the first pair of contact blades, still directly to the electrical system of the timer, which, however, by normally being in "open" condition, stops it without the second pair of contact blades being fed.

In this condition, "closing" the circuit, which is carried out by revolving the timer control knob, is made impossible by the lock imposed by the safety pawl to the cam which makes an integral part of the same knob.

Still a further important feature of the instant finding consists in that the apparatus was provided with a plurality of check valves, in order that in the case of the check valve installed on the water tank, any water losses are drained towards the external environment and, on the contrary, the pressure equilibration inside its interior is favoured, for better pump efficiency;

in the case of the check valve installed on the water jet outlet duct, the increase in pressure of said outward-directed water jet is favoured; the toroidal chamber which contains the pump impeller is kept saturated; and, furthermore, no involuntary water losses from the diffuser nozzle may occur when the apparatus is placed in vertical position with its diffusion nozzles being directed downwards.

On the contrary, the valve installed in the water delivery duct from the steam pump to the evaporation chamber of the heat accumulator, performs the task of overcoming and compensating for the back-pressure exerted inside the duct by steam which is being generated, allowing water to enter and preventing any noxious steam return flow.

To the so conceived finding a large number of modifications and variants may be made, all of them being encompassed by the scope of the inventive concept.

Furthermore, all details may be replaced by other, technically equivalent, elements.

In practice, the materials used, provided that they are compatible with the planned specific use, as well as the contingent shapes and sizes of the instant finding, may be any, according to any desired requirements.

Although a preferred embodiment of the invention has been specifically illustrated and described herein, it is to be understood that minor variations may be made in the apparatus without departing from the spirit and scope of the invention, as defined the appended claims.

What is claimed is:

1. A cleaning/disinfecting apparatus for bathrooms and toilets comprising a body (1) including a tank (2) adapted to be filed with water, a water duct (18) and a steam duct (24) each having respective water and steam outlets (25, 19, respectively), said water duct (18) and said steam duct (24) being in fluid communication with said tank (2), pump means (11) for selectively pressurizing the water and steam of the respective water duct (18) and steam duct (24) prior to exiting the respective water and steam outlets (19, 25) thereof, heating means (23) for transforming water into steam prior to the latter exiting the steam outlet (25), power accumulator means (5) for accumulating power for energizing said pump means (11) and said heating means (23), circuit means (14) including switch means (7) for selectively energizing said pump means (11), support means for supporting said body (1) in a "charging" position, said support means including transformer means (38) for converting high voltage input from an electrical source to low voltage output, electrical contact means (29, 30) of said support means for connecting and disconnecting the low voltage output through electrical contact means (15, 16) of said body (1), and said circuit means (14) connects said electrical contact means of said body (15, 16) with said heating means (23), and said power accumulator means (5) whereby the low voltage output is utilized for steam generation and pump energization.

2. A cleaning/disinfecting apparatus for bathrooms and toilets comprising a body (1) including a tank (2) adapted to be filled with water, a water duct (18) and a steam duct (24) each having respective water and steam outlets (25, 19, respectively), said water duct (18) and said steam duct (24) being in fluid communication with said tank (2), pump means (11) for selectively pressurizing the water and steam of the respective water duct (18) and steam duct (24) prior to exiting the respective water and steam ducts (19, 25) thereof, heating means (23) for transforming water into steam prior to the latter exiting the steam duct (25), power accumulator means (5) for accumulating power for energizing said pump means (11) and said heating means (23), circuit means (14) including switch means (7) for selectively energizing said pump means (11), support means for supporting said body (1) in a "charging" position, power means (38) for charging said power accumulator means (5) when said body (1) is in its "charging" position, timer means (36) for preselecting a charge time, and means (33) operative upon the removal of said body (1) from said support means for preventing operation of said timer means (36) and the charging of said power accumulator means (5) through said circuit means (14).

3. The cleaning/disinfecting apparatus as defined in claim 2 wherein said means (33) for preventing operation of said timer means (36) is a pivotally mounted pawl.

4. The cleaning/disinfecting apparatus as defined in claim 2 wherein said means (33) for preventing operation of said timer means (36) is a pivotally mounted pawl, and spring means (41) for biasing said pawl (36) to its timer means operation preventing position.

5. The cleaning/disinfecting apparatus as defined in claim 2 wherein said support means includes transformer means (38) for converting high voltage input from an electrical source to low voltage output, electrical contact means (29, 30) of said support means for connecting and disconnecting said low voltage output with electrical contact means (15, 16) of said body, and said circuit means (14) connects said last-mentioned electrical contact means (15, 16) with said heating means (23), and said power accumulator means (5) whereby the low voltage output is utilized for steam generation and pump energization.

* * * * *